US006802336B1

(12) United States Patent
Holmquist

(10) Patent No.: US 6,802,336 B1
(45) Date of Patent: Oct. 12, 2004

(54) HOSE REEL APPARATUS

(75) Inventor: Michael W. Holmquist, Burnsville, MN (US)

(73) Assignee: Ventaire, Inc., Burnsville, MN (US)

( * ) Notice: Subject to any disclaimer, the term of this patent is extended or adjusted under 35 U.S.C. 154(b) by 0 days.

(21) Appl. No.: 10/732,573

(22) Filed: Dec. 10, 2003

(51) Int. Cl.[7] ..... B65H 75/34

(52) U.S. Cl. ..... 137/355.2; 137/355.16; 137/355.21; 137/355.27; 242/390.9; 242/407

(58) Field of Search ..... 137/355.16, 355.21, 137/355.27, 355.2; 242/390.9, 407

(56) References Cited

U.S. PATENT DOCUMENTS 2,514,862 A * 7/1950 Hannay ..... 137/355.2
2,573,868 A * 11/1951 Newell ..... 137/355.21
2,669,483 A * 2/1954 Fletcher ..... 222/333
2,963,227 A * 12/1960 Lambert ..... 239/197
5,289,845 A * 3/1994 Sipos et al. ..... 137/355.27

* cited by examiner

*Primary Examiner*—A. Michael Chambers
(74) *Attorney, Agent, or Firm*—Clayton R. Johnson

(57) ABSTRACT

The hose reel apparatus includes a tube motor having a housing that at one end is bolted to a mounting bracket leg to extend within the reel drum and a motor shaft extending within and connected to one end portion of a sheath tube which is also extends within the drum. The opposite end portion of the tube is connected to the reel side plate which is adjacent to the above mentioned leg to rotates the reel. Swivel mechanism is mounted to the other mounting bracket leg, and extends into the drum and is adapted to be non-rotatably connected to a conduit and to a hose that is to be wound onto and unwound from the reel drum.

12 Claims, 2 Drawing Sheets

HOSE REEL APPARATUS

BACKGROUND OF THE INVENTION

This invention relates to an electrically powered reel apparatus for winding and unwinding a hose.

In U.S. Patent to Ritter, U.S. Pat. No. 5,531,246, there is disclosed a hose reel that includes a spool having a drum and flanges and a motor extending partially into the drum. The motor shaft is in driving relationship to a spacer disk that is secured to the drum interior surface axially intermediate the flanges. A swivel is located in the end of the drum opposite the mounting of the motor to the base while a fitting is mounted to the drum to rotate therewith and is fluidly connected between the swivel and the hose that is to be wound on the drum. The hose is unwound by pulling and wound by actuation of the motor.

Referring to U.S. Patent to Dubay, U.S. Pat. No. 4,721,833, there is disclosed a cord reel having a hub with a motor mounted therein and hub end plates which are mounted for rotation by a base: A set screw locks the motor housing relative to the mounting bracket, the mounting bracket being mounted to the base end plate. The motor shaft, which is axially opposite the mounting bracket, mounts a drive wheel for rotating drive gears which in turn rotate the reel. The drive results from the frictional engagement of the drive wheel with tapered portions of the drive gears.

In U.S. Patent to Vandamme, U.S. Pat. No. 6,443,830, there is disclosed a reel driven by a motor, such as a drum motor, which is located in the hub of the reel (see FIGS. 4 and 5). The reel can be driven in each of a winding direction and an unwinding direction.

U.S. Pat. No. 4,993,449 to Stutzman et al discloses a hose reel having a base and mounting disks mountable to the base to rotatably mount the reel. A motor is mounted to one of the disks to extend within the reel hub and through a gear rotates a spindle to rotate the reel. One end of the spindle is adapted to have a hose connected thereto for supplying fluid to a hose that is to be wound and unwound by rotation of the reel, the motor being reversibly driven.

U.S. Patent to Lambert, U.S. Pat. No. 2,963,227, discloses a hose reel wherein a motor is mounted within the reel hub, the motor, through a sprocket chain arrangement at one axial end of the hub, drivingly rotates the reel. The axial opposite end of the hub is mounted by structure separate from that mounting the motor with there being a rotatable joint in fluid communication with the conduit for conducting fluid from the exterior of the reel to the hose that is wound on the reel. The conduit includes a leg that is axially intermediate the reel flanges.

In order to make improvements in structure such as disclosed in the above mentioned patents, this invention has been made.

SUMMARY OF THE INVENTION

The hose reel apparatus includes a mounting bracket that rotatably mounts a reel drum assembly with a first mounting bracket leg mounting an electric, reversible tube motor to extend within the assembly drum. A motor sheath tube has a tube motor extending axially therein and adjacent to the first mounting bracket leg, has an end portion joined to the adjacent drum assembly first side wall and an axially opposite end portion drivenly connected to the motor shaft. The axially opposite, second mounting bracket leg mounts swivel mechanism to have a rotatable portion extend within the drum to open to an opening in the drum for having an end portion of a hose extendable through the opening and being fluidly connectable to the rotatable portion of the swivel mechanism. The swivel mechanism has a stationary portion that rotatably mounts the second drum assembly side wall and is mounted to the bracket second leg to extend therethrough.

DETAILED DESCRIPTION OF THE INVENTION

Figure 1:
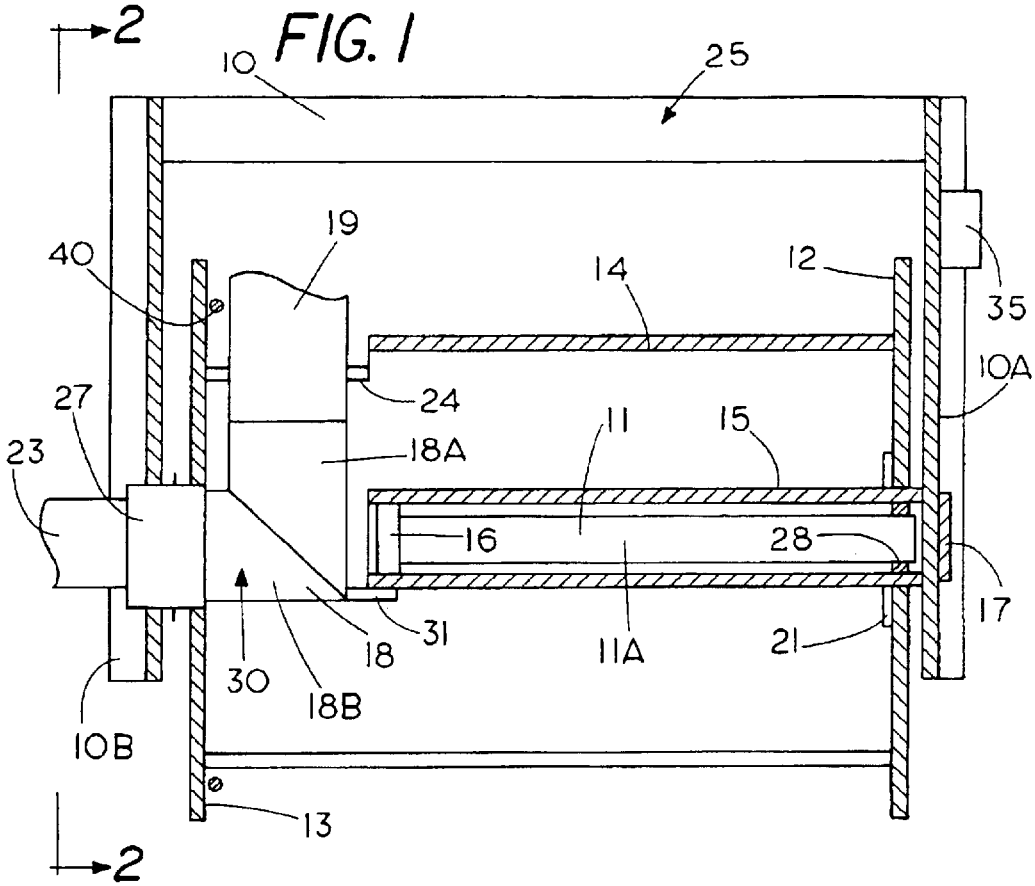
FIG. 1 is a cross sectional view, somewhat diagrammatic, of the hose reel apparatus that is generally taken along the line and in the direction of the arrows 1—1 of FIG. 3.
Figure 2:
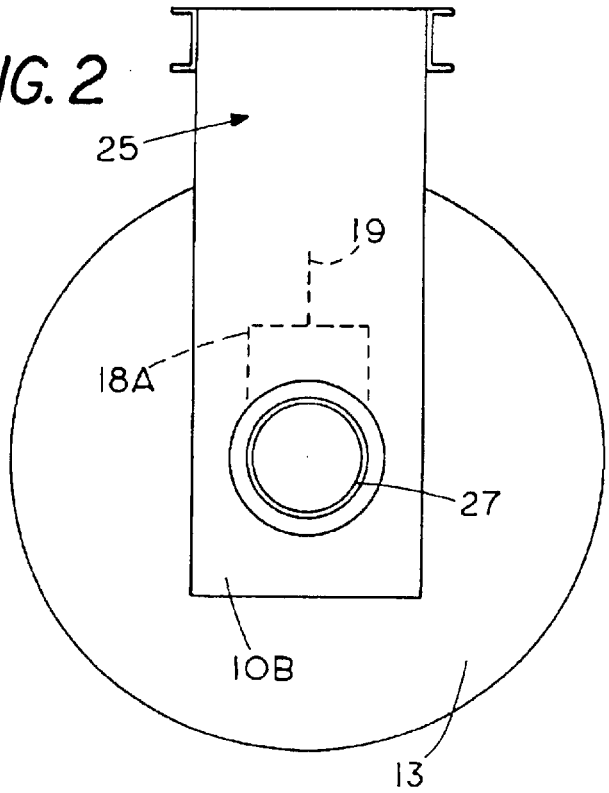
FIG. 2 is an end view that is generally taken in the direction of the arrows 2—2 of FIG. 1.
Figure 3:
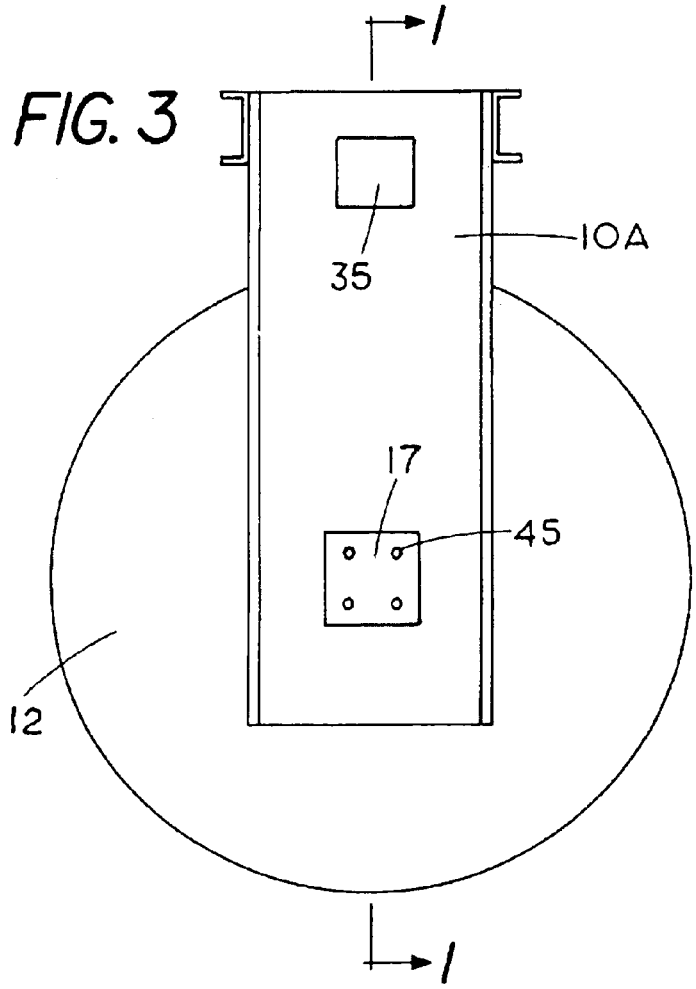
FIG. 3 is an end view that is axially opposite of the end portion that is shown in FIG. 2.
Figure 4:
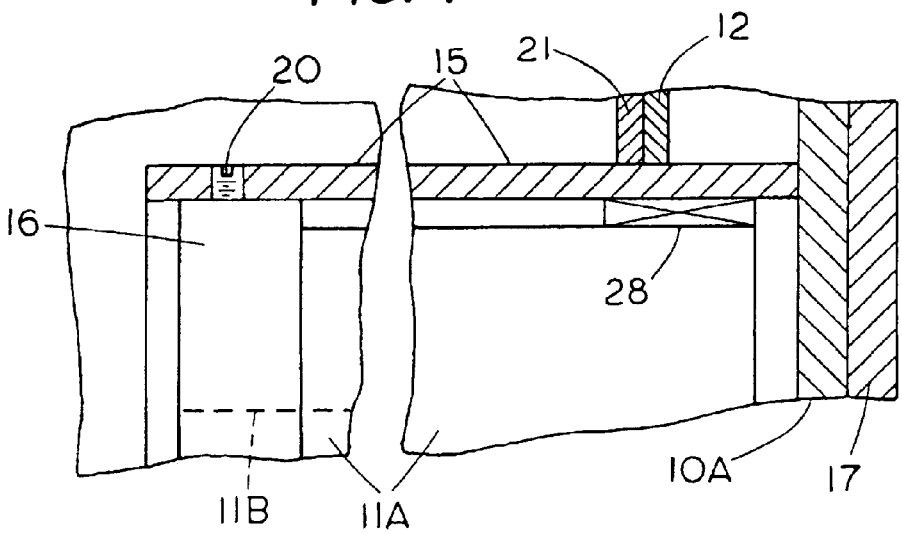
FIG. 4 is an enlarged fragmentary view showing the drive connection between the motor shaft and the tube motor sleeve.

The hose reel apparatus includes a reel drum assembly, generally designated 25, and a generally U-shaped mounting bracket 10 having axially spaced, first and second, generally parallel legs 10A, 10B. An axially elongated reversible electric tube motor 11 has an elongated housing 11A that at one end abuts against the leg 10A and on the axially opposite side of the leg there is a mounting plate 17 having bolts 45 extended through the plate and leg 10A and threaded into the adjacent end of the motor housing to mount the motor to the mounting bracket. The motor extends within the circular cylindrical reel drum 14 of the reel drum assembly. The reel drum assembly also includes axially spaced, annular side plates (flanges) 12, 13 fixedly joined to axial opposite ends of the drum and are of substantially larger outer diameters than that of the drum and substantially smaller inner diameters than that of the drum. Instead of a circular cylindrical drum, there may be circumferentially spaced, circumferentially curved slats (not shown) extending axially between and joined to the side plates.

A motor sheath tube 15 is rotatable relative to the motor housing 11A with there advantageously being a bearing 28 between one end portion of the sheath tube and the motor housing and being axially adjacent to the side plate 12. An annular drive member 16 is keyed to the motor shaft 11B and a screw 20 secures the end portion of the sheath tube which is axially opposite the side plate 12 to the drive member to rotate therewith. The sheath tube mounts an annular member 21 which is joined to the side plate 12 whereby as the tube is rotated, the drum assembly is rotated. The axis of rotation of the motor shaft is coextensive with the axis of rotation of the drum. The inner diameters of each of the side plates is at least as great as that of the sheath tube outer diameter. Substantially the entire motor and tube are located within the drum, the end portion of the sheath tube axially opposite the drive member 25 extending sufficiently through the opening in the side plate 12 so that the side plate is axially spaced from leg 10A to permit the mounting of limit switches (not show) therebetween for controlling the energization and deenergization of the motor to prevent winding or unwinding of the hose 19 onto and from the drum. The limit switches are conventional for controlling the number of revolutions in clockwise and counterclockwise directions to prevent the reel assembly overwinding or unwinding the hose that is connected to the elbow 18. The sheath tube is of an axial length to extend axially further from the side plate 12 than the motor housing.

Fluid swivel assembly, generally designated 30, includes a rigid, generally L-shaped, rigid duct elbow 18 having a leg 18A that is adapted to have one end of a flexible hose 19 secured thereto to extend through an opening 24 in the drum. The elbow includes an elbow leg 18B that extends at right angles relative to leg 18A and is rotatably mounted by a swivel member 27 which extends through the side plate 13 and mounts the side plate 13 for rotation relative thereto. The swivel member 27 and the elbow leg 18B have their central axes coextensive with the axis of rotation of the motor shaft. Thus, the elbow is mounted for rotation about an axis coextensive with the axis of rotation of the motor shaft and drive member 16. The elbow is axially spaced from the end of the sheath tube that is remote from the mounting bracket leg 10A. A rigid bar 31 at one end is joined to one end of the sheath tube and at its opposite end joined to the elbow for stability. The elbow leg 18A is adapted for mounting one end of the hose 19 to have the hose extend away from the motor shaft axis of rotation and radially through the drum opening 24 while the swivel member is adapted for having one end of a fluid conduit 23 connected thereto whereby the conduit is not rotated as the drum assembly is rotated to wind or unwind the hose.

A spring 40 extends around the drum for abutting against the side plate 13 and the end portion of the hose 19 that is connected to the elbow 19A for urging the adjacent portion of the hose axially way from the side plate 13 so that the hose is wound around the drum as the drum is rotated.

A switch box 35 is mounted to the bracket leg 10A and contains a conventional switch (not shown) movable between an off-position, a hose winding position and an hose unwinding position which through electric connections (not shown) to the motor, control the energization of the motor to rotate in either a winding or an unwinding direction and to deenergize the motor. As the motor is energized to rotate the drum in a hose winding direction, the hose, in abutting against an axial drum edge that in part defines the opening 24, is wound around the drum assembly. If the motor is energized to rotate the drum assembly in the opposite angular direction, the hose is unwound from the drum assembly. Due to the provision of the swivel mechanism, the fluid conduit 23 is not rotated while remaining in fluid communication through the swivel mechanism to the hose during the time the reel assembly is being rotated in a winding or unwinding direction. As noted above, limit switches prevent the motor being energized to over wind and unwind the hose.

As an example, the conduit may be connected to an air exhaust fan (not shown) while the hose may be unwound from the reel to be adjacent to the exhaust of a combustion engine, or as another example, the conduit may be connected to a source of water under pressure while the end of the hose opposite its connection to the elbow may be manually moved to discharged the water at a desired location. It is to be understood that the reel apparatus may be used for conducting fluids other that air and water and that the hose may be of a length that is in overlapping windings on the reel drum. Further, it is to be understood that the switch box may be located remote from the reel assembly and have its switch (not shown) suitable connected to the motor to control the energization and energization of the motor. It would also be possible to use a reversible hydraulic or air motor in place of the electric motor.

Additionally, it is to be understood that the diameter of the opening 24, hose, conduit and swivel mechanism may be much smaller relative the diameter of the hub than that shown and the outer diameter of the side plates may be of sizes relative to the drum than that shown.

What is claimed is:

1. Hose reel apparatus for having a hose wound thereon and unwound therefrom and adapted for providing a fluid connection between a fluid conduit and the hose, comprising, a mounting bracket having axially spaced bracket first and second legs, an axially elongated reversible tube motor having a motor housing that includes a first end portion mounted to the first leg to have the housing extend axially toward the second leg and a motor drive shaft having an axis of rotation and is axially opposite the first leg, a reel assembly axially between the first and second legs and having an elongated drum that has axially opposite first and second end portions, a first annular side wall joined to the drum first end portion and a second annular side wall joined to the drum second end portion and being adjacent to the second leg, means for drivingly connecting the motor shaft to the first side wall and mounting the first side wall to rotate about an axis coextensive with the motor shaft axis of rotation with the motor housing extending axially between the side walls and swivel mechanism mounted to the second leg to extend through the second side wall and into the drum, said swivel mechanism including an end portion adapted to have the hose connected thereto, the swivel member end portion being located in the drum and rotatable relative the mounting bracket about an axis coextensive with the shaft axis of rotation.

2. The apparatus of claim 1 wherein said means comprises a sheath tube drivenly connected to the motor shaft and having the motor housing extending therein.

3. The apparatus of claim 2 wherein the motor housing extends within said tube.

4. The apparatus of claim 3 wherein the tube has one end portion drivenly connected to the motor shaft and an axially opposite end portion drivingly connected to the first side wall.

5. The apparatus of claim 3 wherein the first side wall has a central opening and the motor housing sheath tube extend through said central opening.

6. The apparatus of claim 3 wherein the swivel mechanism includes a rigid right angle elbow that is rotatable relative to the mounting bracket and extends within the drum and includes the swivel mechanism end portion.

7. Hose reel apparatus for having a hose wound thereon and unwound therefrom and providing a fluid connection between a fluid conduit and the hose, comprising, a mounting bracket having axially spaced bracket first and second legs, an axially elongated reversible tube motor having, a first end portion mounted to the first leg to extend axially toward the second leg and a rotatable drive member axially opposite the first leg with an axis of rotation, an axially elongated sheath tube having the motor extended therein and a first end portion rotatably mounted on the motor first end portion and a second end portion connected to the drive member to rotate therewith, a reel assembly axially between the first and second legs that includes an elongated drum having axially opposite first and second portions, an annular first side wall joined to the drum first end portion and an annular second side wall joined to the drum second end portion and being adjacent to the second leg and swivel mechanism mounted to the second leg to extend through the second side wall and into the drum, said swivel mechanism including an end portion adapted to have the hose connected thereto and being located in the drum and rotatable relative to the mounting bracket about an axis coextensive with the drive member axis of rotation.

8. The apparatus of claim 7 wherein the swivel means includes a generally right angle elbow that is rotatably with the reel assembly, the elbow including the swivel end portion that extends at generally right angle to swivel mechanism axis.

9. The apparatus of claim 7 wherein there is provided means for interconnecting the elbow and the tube second end portion.

10. The apparatus of claim 7 wherein the motor includes a motor housing having the motor first end portion and the sheath tube has the motor housing extending therein and the sheath tube first end portion in part extends axially between the first side wall and the first bracket leg.

11. The apparatus of claim 10 wherein the sheath tube is of a greater axial length than its diameter and the drive member includes a drive shaft of the motor.

12. The apparatus of claim 10 wherein the side walls are of inner diameters smaller than the inner diameter of the drum and at least as great as that of the sheath tube and larger outer diameters greater than that of the drum.

* * * * *